United States Patent [19]

Deruelle et al.

[11] 4,038,153

[45] July 26, 1977

[54] COKE MANUFACTURING PROCESS

[75] Inventors: Jean Deruelle, St. Avold; Olivier Penet, Forbach, both of France

[73] Assignee: Houilleres du Bassin de Lorraine, Freyming-Merlebach, France

[21] Appl. No.: 588,172

[22] Filed: June 18, 1975

[30] Foreign Application Priority Data

June 27, 1974 France ..... 74.22402

[51] Int. Cl.[2] ..... C10B 49/06; C10B 57/12; C10B 57/18

[52] U.S. Cl. ..... 201/27; 201/32; 201/36; 201/38; 202/131; 202/218

[58] Field of Search ..... 201/27, 32, 38, 34, 201/1, 36; 202/131, 218

[56] References Cited

U.S. PATENT DOCUMENTS

| | | | |
|---|---|---|---|
| 955,310 | 4/1910 | Beehler | 201/27 |
| 1,602,819 | 10/1926 | Jakowsky | 201/36 |
| 2,710,280 | 6/1955 | Borch | 201/27 |
| 2,813,822 | 11/1957 | Collier | 201/27 |

FOREIGN PATENT DOCUMENTS

| | | | |
|---|---|---|---|
| 1,813,283 | 8/1970 | Germany | 202/218 |
| 243,141 | 1/1911 | Germany | |

*Primary Examiner*—Barry S. Richman
*Assistant Examiner*—Bradley Garris
*Attorney, Agent, or Firm*—Cushman, Darby & Cushman

[57] ABSTRACT

Pulverulent coke and granular reactive coke are produced, respectively, from fines and grains of coal of grades which are not normally usable for coking, containing more than 15% of volatile matter and having a swelling index between 1 and 8, by carbonization between 600° C and 1100° C, wherein combustion air in excess of that which would be necessary to bring the coke to the desired coking temperature is introduced into a slightly inclined rotary tubular oven through which the coal passes during its conversion into coke, the air introduction being effected between the coke outlet and the zone in which the product reaches its maximum temperature and being controlled so that the temperature of the gases issuing from the oven is kept above 600° C. At least 60% of the air is preferably introduced at the downstream end of the oven, and further air may be introduced at intermediate points along the oven length. An endothermic fluid such as water may also be injected at the downstream end of the oven. Preferably the lowest rate of temperature rise of the product (10° to 15° C/min) is in the 300° to 450° C temperature zone of the oven.

5 Claims, 3 Drawing Figures

PERCENTAGE
%
40
30
20
10
0
A
EVOLUTION OF THE VOLATILE MATERIAL CONTENT
TEMPERATURE
°C
700
600
500
400
300
200
100
0
TEMPERATURE OF THE PRODUCT
B
DISTANCE ALONG THE OVEN COUNTED FROM THE POINT OF INTRODUCTION OF COAL
11
POINTS OF INTRODUCTION OF:
WATER
AIR
9
0
5
10
15
20
25
30
35
36.7m
14
15
16
POINTS OF INTRODUCTION OF: AIR
AIR
AIR
DISTANCE ALONG THE OVEN COUNTED FROM THE POINT OF INTRODUCTION OF COAL 3
17
17
17
17
17
10
8
9
14
Z
15
1
16
11
7

COKE MANUFACTURING PROCESS

BACKGROUND OF THE INVENTION

1. Field of the Invention

The invention relates to a coke manufacturing process according to which coal is introduced upstream of a slightly inclined rotary tubular oven, through which the product, in the course of its processing, moves from the upstream end to the downstream end, in which the calories required for carbonization are obtained by means of the combustion of part of the volatile constituents of the processed coal, by means of the introduction of air into the oven, the process being applied to the production respectively of pulverulent coke and of reactive coke in grain form, respectively from fines and coal grains containing more than 15% of volatile matter, with a swelling index ranging between 1 and 8, by means of carbonization between about 600° and 1100° C.

2. Description of the Prior Art

The coals of the type with which the invention is concerned cannot, in known manner, be carbonised unless use is made of complicated techniques whose object is to preserve them from mass agglutination as they pass through the plastic stage before resolidification. Thus, it is known to carbonize them in a bed of inert material such as sand or pulverulent coke, sometimes in the form of agglomerate. The heat required for carbonization is then supplied partly by the pulverulent solid and partly through gas combustion. But in practice the operator avoids taking as a starting material coal with too high a swelling index and with a volatile matter content in excess of 15%, that is to say coal of the type with which the invention is concerned.

It is known from German Pat. No. 243,141 to employ a process of coke manufacture from coal which is not normally usable for coking, in which the coal is subjected to limited degassing in a revolving oven. In this process the air and the combustion gas may be introduced at a certain distance from the outlet of the revolving oven. But if an attempt is made to apply this process to the coal referred to above, great adjustment difficulties have to be faced. The carrying out of the known process is characterized by a steady increase of the temperture of the processed product, from the inlet to the outlet of the oven, where it reaches the desired coking temperature. This technique cannot at present be applied to coal of the type with which the invention is concerned.

Indeed, if it is desired to apply such a process to the pyrolysis of products having a high volatile matter content, containing more latent heat than is required to heat the oven, it is observed that it is almost impossible to maintain a stable temperature regulation, even by distributing air inlets throughout the length of the oven. If, indeed, the flow of injected air decreases, the oven lacks heat, the product comes out less coked, and no longer possesses the desired quality. If the air flow increases, even very slightly, as a result, for example, of unavoidable stray inflows, the temperture of the flame rises very rapidly and therefore the coking temperature rises also, modifying the quality of the coke still further. But, in addition, as soon as the coke reaches the temperature at which it is completely degassed, the air finds no more gas to be burnt and advances into the oven until it finds some; the flame goes further down and the adjustment of temperatures is completely disturbed.

If agglutinating coal is used, there is in addition the tendency that the coal grains will stick together, forming "pellets" the cores of which are poorly coked and which may even lead to the clogging of the revolving oven.

SUMMARY OF THE INVENTION

An object of the invention is to obtain either pulverulent coke, or granular reactive coke, by means of the carbonization of coal of the type defined at the beginning of this specification, this being done by means of a self-heating process to avoid the introduction of external calories, in a continuous oven. The achievement of this object assumes the solution of specific problems.

Another object of the invention is therefore to overcome these difficulties inherent in the nature of the coal defined at the beginning.

These objects are achieved, in the process according to the invention, as a result of the introduction into the oven, between the outlet for the coke and the area of maximum temperature reached by the product, of an amount of combustion air in excess of that which would be necessary to bring the coke to the desired coking temperature, said amount of air being regulated, within stoichiometric proportion limits, in such a manner that the temperature of the gases issuing from the oven is thus kept above 600° C.

To adjust the rule of the heating of the treated product as a function of its progress in the oven, it is therefore in conformity with the invention that the excess combustion air introduced into the oven should be regulated within stoichiometric proportion limits as a function of the temperature of the gases issuing from the oven. It is to be understood therby that the quantity of air introduced is greater than that which would be necesary to bring the coke to the desired coking temperature while remaining below the quantity required to obtain stoichiometric combustion of the gases. In other words, the fumes issuing from the oven must, in any case, remain reducing.

The Applicants have observed that under these conditions the flame moves down into the oven and, as a result of deferred combustion, stabilises upstream of the point in the oven where the product processed reaches the desired temperature, this point being determined by the heat exchange capacity between gas and solid upstream of the oven. In this way a stable temperature pattern is obtained, the relative variations of the air flow having an incidence only on the outflow temperature of the residual gases while there is an excess of air.

It is advantageous that 60% at least of the total amount of air introduced should be introduced through the downstream end of the oven.

Part of the calories may be obtained by means of the combustion of the gaseous products of the processing in make-up air introduced at one point at least along the oven.

It is also in accordance with the invention to inject fumes or water at the downstream end of the oven. In this event, this endothermic fluid mixed with the combustion air cools the coke as it progresses in the oven and, reaching the maximum temperature point of the product, it meets the first distillation gases, creating a flame whose temperature is all the lower as the relative flow of the endothermic fluid is considerable. As the flame is less hot, the coking temperature is lower.

It is advantageous, moreover, for the heating rule to comprise an area of smaller temperature rise of the product of the order of 10° to 15° C/min, in the 300°–450° C temperature zone.

It will be possible to obtain the area of smallest temperature rise through the accumulation of product in its plastic phase by means of the regulation of the oven revolution speed.

The adjustment of the rate of injection of air and of injection of the endothermic fluid thus makes it possible to fix at the desired levels the product temperature rise rule, the maximum temperature reached and the coke cooling rule. It is advantageous to keep the coke for a certain time at a high temperature if agglutinating coal is being processed; the pellets coke to the core and disintegrate.

According to an alternative, this area of smallest temperature rise will be obtained by a widening of the oven, as described for example in British Pat. No. 1,246,992.

It is finally advantageous to create in the oven a slight regulated pressure drop by means of a draught through a flue at high temperature of the order of 600° C or by means of the combustion of the residual gases in a natural or forced draught combustion flue.

DETAILED DESCRIPTION OF THE INVENTION

Figure 1:
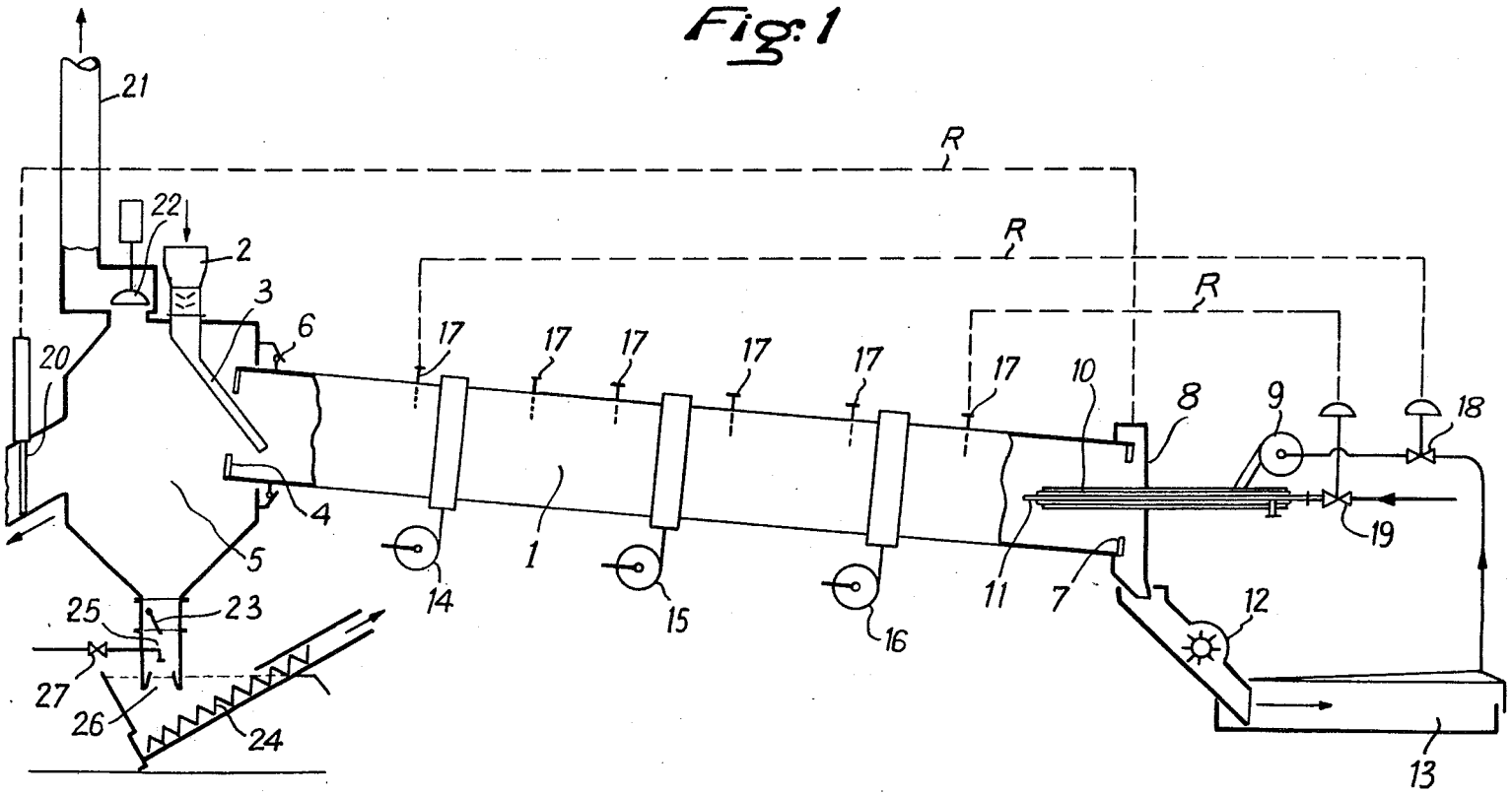
FIG. 1 is a partly sectioned longitudinal diagrammatic view of a revolving oven of a per se known type, but adapted for the carrying out of the process according to the invention.

The process according to the invention will be described and commented in more detailed fashion on the basis of FIG. 1.

In the following description, as well as in the foregoing, coal properties are determined according to AFNOR standards. Pulverulent or granulated coal of the type with which the invention is concerned is introduced, after metering, into a revolving tubular oven 1, of a length of 37 meters and an external diameter of 2 meters, with a 3% incline, through the use of a funnel 2 and a channel 3. This oven may revolve at a speed of 0.6 to 3.6 revolutons per minute, and it is fitted with an air fan 9 of 5600 cubic meters per hour output regulated by a valve 18, with three air fans 14, 15, 16 of 3000 cubic meters per hour output for supplying three sections of the oven, with a lighting burner 10 and with a water injection pipe 11 supplied by means of a valve 19.

Oven 1 is lined internally with insulating refractory material. On the upstream side, that is to say the coal input side, it is fitted with a solid lip or sill 4 leaving a circular opening allowing gases to pass, and restraining the product from falling out into a smoke chamber 5. A relatively seal-tight joint 6 effects the connection between the oven and the smoke chamber. The oven of FIG. 1 has in addition pyrometric rods 17 for the measurement of the temperature of the product and of the gases for the purpose of regulation of the air intake valve 18 and of the water injection valve 19. The residual gases issuing from the smoke chamber are led towards a post-combustion chamber by means of a pipe fitted with a regulated adjustment damper 20, or towards an emergency chimney 21 through the medium of a bell-valve 22 controlled to be fully open or fully closed by a jack.

The smoke chamber 5 is lined with a refractory lining for 1000° C and is provided with a hopper which collects any of the product spilling from the input sill 4, particularly the fines which are entrained by the flue gases and deposited therefrom. The outlet of this hopper is fitted with a normally open shutter 23 and a pipe whose end is immersed in a water-filled hopper containing a take-up screw 24, thus forming a hydraulic guard.

A water atomizer 25 operated by a valve 27 facilitates the bringing down of the fines in the pipe and supplies the hydraulic guard which operates with a constant level. The take-up screw is incined in such a manner that it takes up at the surface the products that float and at the bottom those that are precipitated. A system of internal shutters 26 permits the periodical extraction from the pipe of the floating products.

The removal of the coke may be effected through small hollow elements acting as indirect coolers (spraying of the external surface by water in closed circuit) and opening out into a spiral member fitted with a screen, or, as shown, by sliding over an inclined channel fitted with a lump-crusher 12 and spreading on a vibrating table 13 or other device for possible additional extinguishing. Regulation circuits are symbolised by the reference letter R.

The product moves forward in the oven under the action of rotation and the incline. It dries, begins to release gases, then is coked in contact with the hot gases resulting from the combustion of the volatile matter, and circulating in counterflow. After conversion into coke, the product is cooled down to come out through an annular grid 7. The heating hood 8, lined internally with refractory material, seals the outlet and carries a nozzle with the air fan 9 fitted with the gas burner 10 for starting, and the tube 11 for water spraying.

By introductng coal with a high volatile matter content (37.8% according to the MO3 004 standard) and with an agglutination index of 5 (according to Afnor Standard M11.001) the production is achieved of a coke with 4% volatile matter at a rate of 9 tons per hour with a rotation speed of 3.3 r.p.m.

Gases come out at 790° C. The pressure drop at the oven hood is kept at 0.1 millibar. The delivery temperature of the coke if 100 to 150° C. The maximum temperature reached by the product is 700° C. The amount of air injection by the heating hood fan is 4000 $m^3$/hour, and that introduced by the fans along the oven is a total of 500 $m^3$/hour, the amount of water injected by the spray tube 11 being 1300 liters per hour. The hot gases pass into the smoke chamber 5 provided with the hopper which collects any of the product spilling from the entrance sill and the fins swept along by the smoke that is decanted. The inclined screw 24 extracts the mixture of solids and soot.

The coke obtained has the following properties measured according to the suitable methods described in the work by R. Loison, P. Foch, A. Boyer, "Le Coke", Dunod, Paris, 1970:

Bulk Density for 4/20 mm — 0.273
Apparent Density — 0.544
Macroporousness measured with mercury — 66%
Resistivity ($\Omega$/cm/$cm^2$) — 300
Reactivity I 30 at 1000° C — 1

Specific surface determined with water vapour by means of Mc Bain balance — 300 to 600

This oven makes it possible to treat products of varying grain sizes ranging from fines 0/7 to grains 15/35, the grain size of the coal fed in being selected as a function of the grain size desired for the coke. If, for example, coke 10/20 is desired, the size of the grains in the batch fed into the oven will be 7/15 or 10/20. If 4/10 is required, 6/10 will go in, or 0/7 or 0/10 fines with the sludge removed.

The specialist will understand that the example of application which has just been described leads to very surprising results, there being involved a coal as agglutinating and with as high a volatile matter content as the one treated.

Other comments are now necessary for a better understanding of the operational conditions according to the invention which have made it possible to obtain the foregoing result and to permit the adaptation of these operational conditions to other coal of the types with which the invention is concerned.

It will have been understood that, as it progresses, the temperature of the product rises up to the desired maximum, then in cools down on nearing the downstream point of the revolving oven. In the vicinity of 350° C the volatile matter begins to be released. At about 500° C the product reaches the plastic zone, this being the beginning of the transformation of the coke which ends towards 800° C. The heating rule in this 350° - 800° C zone determines the quality of the coke and can be adjusted according to the invention.

The phenomena are complex. It may be observed that too fast a temperature rise in the 350° - 550° C zone increases the plasticity of the coal, the swelling of the grains and multiplies grain adherence with the formation of "pellets" the core of which is poorly coked. In this case, it might be though that the coking of coke at high temperatures (950° to 1100° C) could disintegrate these pellets and would present no disadvantage for certain outlets. But the demand of industrial users is directed to a large extent towards coke coked at about 800°-850° C of even650°-700° C, only. Hence the interest of the process according to the invention.

If, furthermore, air is injected without taking precautions with coal of the type with which the invention is concerned and especially if the swelling index is of the order of 4 or 5 pellets appear. However, the phenomenon becomes stabilised if care is taken, according to the invention, to fix a relatively low temperature rise rule (less than 10° C/min) in the 350° -550° C zone. This result may be achieved by means of the creation of a plastic product threshold in the neighbourhood of 400° C which increases the filling rate locally. The creation of this threshold is obtained by the combination of the temperature-regulated air adjustments and of the oven revolving speed, taking advantage of the fact that the plasticity zone of the product is, as a result of this, the zone of greater viscosity or the zone of greatest slope of the embankment collapse sensitive to the revolving speed of the oven. With the invention the operator is therefore in control of the formation of some sort of a bead of slightly agglutinated product slowing down its progression locally and therefore its temperature rise.

An alternative for the obtaining of the same result of a zone of lowest temperature rise consists in using an oven like the one which will be described on the basis of FIG. 3.

The applicants also endeavoured to regulate without success the outgoing temperature of coke below 900° C with a combustion distributed in stages over the entire length of the oven with the introduction of air at various points. In this event, an excess of air heats the coke beyond 950° C, a temperature at which volatile matter is no longer released. Having nothing to burn, the air introduced into the oven at the delivery of the coke remains available for burning gases. Overheating therefore takes place as soon as the gas appears, and there is a new backward movement of the flame upstream.

If this air is then reduced, the flame returns downstream, and then the temperature of the coke drops as a result of a lack of calories. A lot of gas is then released. The oven is then unstable and adjustment of its temperature is not possible. On the other hand, as soon as the lessons of the invention are applied, it is possible to obtain a stable operation during which there may be obtained a regulated gas outflow temperature comprised between 600° and 700° C, this limiting the choking of the sleeves and circuits. The possibilities of heat transmission between gas and solids being limited, the temperature rise rule becomes stabilised. Maximum temperature (900 to 950° C) is reached between half and two-thirds of the oven, according to the rate.

In the downstream portion the coke cools down, and volatile matter is no longer released. Although there remains only the air which circulates in counterflow to the hot coke, the combustion effect is very limited.

The technique according to the invention of combustion by an excess of air in the downstream portion of the oven leads to a high coking temperature level, of interest for some manufactures.

In order to obtain cokes coked at lower temperature an alternative consists in atomizing water with the air blown into the oven on the coke delivery side. The atomization of this water clearly improves coke cooling. But, in particular, the endothermic effect of water steam limits the combustion temperature of the first distillation gases encountered, and thereby the maximum temperature which the coke may reach.

The regulation of the air flow permits the adjustment of the outflow temperature of the gases. The adjustment of the rate of flow of water permits the regulation of the maximum temperature of the coke. However, a certain amount of air may be injected by means of fans 14, 15, 16 along the oven to maintain the general heat level and remain within the range of adjustment of the gas outflow temperture without, however, exceeding the stoichiometric proportion limit as has been stated.

A slight pressure drop is maintained to permit the outflow of residual gases, while limiting the stray air inflows on the coke delivery side. The stray air flow must remain definitely below that necessary for the process. The high temperature level of these gases permits their evacuation by natural drought, or their easy combustion, and without the production of fumes or liquid effluents or other pollution or nuisance.

Figure 2:
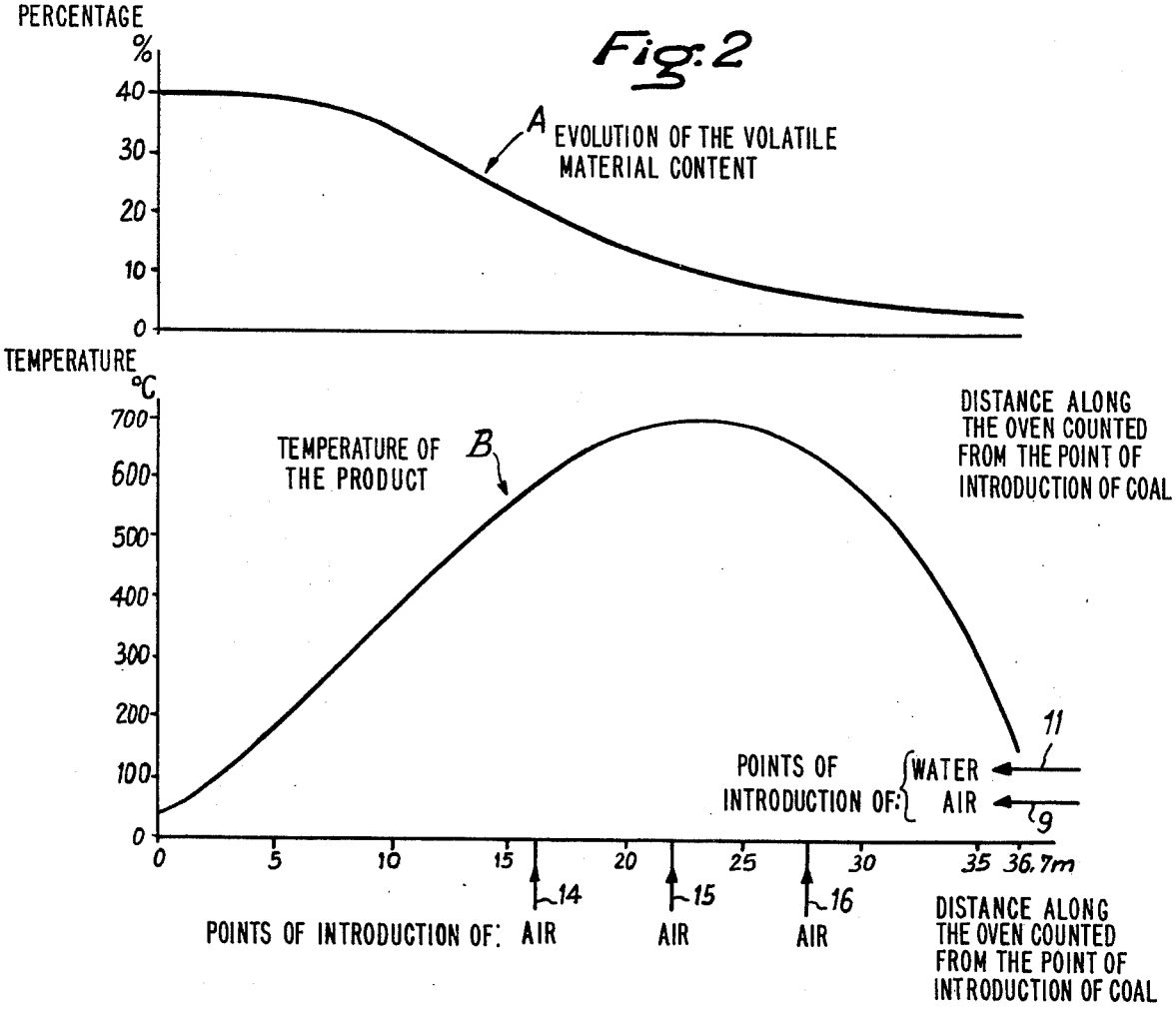
FIG. 2 shows the curves for the volatile matter content, gas temperature and product temperature as a function of distance in relation to the input of the processed products at the upstream point of the oven.

In FIG. 2, curves A and B have been shown, relating to an operational run of a 36.7 m oven according to FIG. 1. Along the abcissae the indication is given in meters of the distance along the oven counted from the point of introduction of coal. Along the abcissae the arrows 9, 14, 15, 16 show respectively the points of introduction of air, and arrow 11 the point of introduction of water. The coal was Wendel coal 12/18 mm with 40% volatile matter, and with a swelling index of 4.5. The 2m-diameter oven with a 3% incline revolved at 3.15 r.p.m. The air outflow was 4800 $m^3/h$ at point 9 and nil at points 14, 15 and 16. The rate of water flow was 2300 kg/h.

Curve A represents the evolution of the volatile matter content of the product as a percentage on pure coal (or coke) and curve B represents the evolution of the temperature of the product in ° C.

Figure 3:
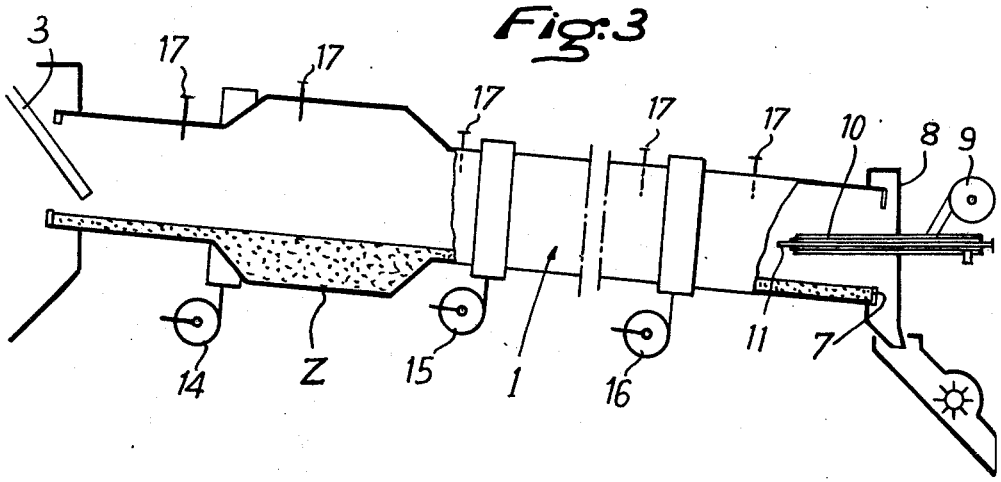
FIG. 3 shows a diagrammatic view in longitudinal cross-section of an oven for the carrying out of an alternative of the process according to the invention.

The oven of FIG. 3 is of a type particularly suited to the carrying out of the invention. In this respect it constitutes an alternative differing from the known cylindrical oven. To simplify explanations, FIG. 3 shows only some of the parts of FIG. 1, which are all identical. Indeed, it must be understood that the functional equipment of the oven of FIG. 3 is exactly the same as that of the oven of FIG. 1. The essential difference between the two ovens is that the zone where the temperature rise slows down is obtained by a particular design of the oven. The latter instead of being entirely cylindrical, has a widening of its diameter in the zone Z in which the desired slowing down of the progress of the product is obtained by local accumulation.

We claim:

1. A manufacturing process for producing pulverulent coke and reactive coke in grain form, in which bituminous coal from fins and coal grains containing more than 15% volatile combustible matter with a swelling index ranging between 1 and 8 is carbonized at temperatures between about 600° and 1100° C in which process said bituminous coal is introduced at the higher end of a slightly inclined rotating tubular oven, through which oven the coke during the course of its production moves from the higher end to the lower end; in which process the heat of carbonization is obtained by the substantially simultaneous in situ generation and combustion of a part of the volatile combustible matter, by introducing an amount of air into the oven, which air is combustion air and which amount is in excess of a quantity of said air which would be necessary to bring the coke to the desired coking temperature, the majority of said air being introduced into the oven at a position between the outlet for the coke and the location of the area of maximum temperature reached by the coke; and wherein an endothermic fluid is introduced at the lower end of the oven for selectively establishing the location of said area of maximum temperature in said oven, for cooling the coke between said location and said outlet and for maintaining the temperature of the gases issuing from the higher end of said oven at about 600° C.

2. A process according to claim 1, wherein at least 60% of the total quantity of air introduced is introduced through the lower end of the oven.

3. A process according to claim 1, wherein the endothermic fluid is water.

4. A process according to claim 1 wherein during the course of production of said coke, a zone of lowest temperature rise is created, said zone being a temperature zone ranging from 300° to 450° C. and in which zone the rate of increase of the temperature of a given segment of coke is of the order of 10 to 15° C/min.

5. A process according to claim 4, wherein the increase in temperature is a result of adjusting the rotating speed of the oven to cause accumulation of the coke in its plastic phase.

* * * * *